US008256388B2

(12) United States Patent
Aixala

(10) Patent No.: US 8,256,388 B2
(45) Date of Patent: Sep. 4, 2012

(54) NOZZLE, LUBRICATION SYSTEM AND INTERNAL COMBUSTION ENGINE COMPRISING SUCH A NOZZLE OR SUCH A SYSTEM

(75) Inventor: Luc Aixala, Soucieu-en-Jarrest (FR)

(73) Assignee: Renault Trulles, St. Priest (FR)

( * ) Notice: Subject to any disclaimer, the term of this patent is extended or adjusted under 35 U.S.C. 154(b) by 522 days.

(21) Appl. No.: 12/518,295

(22) PCT Filed: Dec. 27, 2006

(86) PCT No.: PCT/IB2006/004167

§ 371 (c)(1),
(2), (4) Date: Jun. 9, 2009

(87) PCT Pub. No.: WO2008/078140

PCT Pub. Date: Jul. 3, 2008

(65) Prior Publication Data

US 2010/0037839 A1 Feb. 18, 2010

(51) Int. Cl.
*F01P 7/00* (2006.01)

(52) U.S. Cl. ..... 123/41.35; 123/196 R

(58) Field of Classification Search ..... 123/196 A, 123/41.35

See application file for complete search history.

(56) References Cited

U.S. PATENT DOCUMENTS

| | | | | |
|---|---|---|---|---|
| 3,659,786 | A * | 5/1972 | Vier et al. | 239/5 |
| 3,709,109 | A * | 1/1973 | Howe | 92/186 |
| 3,945,353 | A * | 3/1976 | Dreisin | 123/41.22 |
| 4,047,665 | A * | 9/1977 | Moynihan | 239/124 |
| 4,284,174 | A * | 8/1981 | Salvana et al. | 184/6.4 |
| 4,408,575 | A * | 10/1983 | Clairmont et al. | 123/41.35 |
| 5,713,262 | A * | 2/1998 | Sugiyama et al. | 92/158 |
| 6,928,975 | B2 * | 8/2005 | Lauritsen | 123/196 R |

FOREIGN PATENT DOCUMENTS

| | | | |
|---|---|---|---|
| DE | 19835484 | A1 | 2/2000 |
| FR | 2764006 | A1 | 12/1998 |
| WO | 8403456 | A | 9/1984 |

OTHER PUBLICATIONS

International Search Report for corresponding International Application PCT/IB2006/004167.

* cited by examiner

*Primary Examiner* — Noah Kamen
*Assistant Examiner* — Long T Tran
(74) *Attorney, Agent, or Firm* — WRB-IP LLP

(57) ABSTRACT

A nozzle is adapted to direct a jet of oil under pressure on an internal combustion engine. It has a variable outlet section, and it is provided with mechanical arrangement adapted to control its outlet section on the basis of the pressure of a fluid under pressure provided to this mechanical arrangement, independently of the oil going through the outlet of the nozzle. In the lubrication system an auxiliary line is provided with first proportional means controlling oil flow toward a nozzle. A control line connects a main line or the auxiliary line, upstream of the first proportional means, to a mechanical arrangement adapted to control the outlet section of the nozzle. The control line is provided with a second proportional arrangement controlling the pressure of oil delivered to the mechanical arrangement. The nozzle can be used as a piston cooling nozzle to direct oil toward a piston of an internal combustion engine.

19 Claims, 2 Drawing Sheets

NOZZLE, LUBRICATION SYSTEM AND INTERNAL COMBUSTION ENGINE COMPRISING SUCH A NOZZLE OR SUCH A SYSTEM

BACKGROUND AND SUMMARY

This invention concerns a nozzle used to direct a flow of oil under pressure toward a part of an internal combustion engine. The invention also concerns a lubrication system for an internal combustion engine including, amongst others, at least one such nozzle. Finally, the invention concerns an internal combustion engine equipped with a nozzle or a lubrication system as mentioned here-above.

In order to lubricate moving parts of an internal combustion engine, it is known to use a pump which feeds oil to different locations in the engine. Such a pump represents an important part of the overall engine friction, often between 10 and 20 percent. Oil provided by the pump can be used to feed a support interface for a crankshaft of the engine. It can also be used to feed one or several piston cooling nozzles or jets adapted to direct the flow of oil under pressure toward the underside of a piston of the internal combustion engine. The flow of oil coming out of such a nozzle must have a flow rate and a speed adapted to efficiently cool the piston.

FR-A-2 861 321 discloses a piston cooling nozzle provided with an elastically deformable ring which adapts the outlet section of the jet, depending on the flow rate of oil. With such a device, the speed of the oil flow cannot be controlled independently of the oil pressure which depends on the rotation speed of the engine. In some circumstances, it is desirable to adapt the oil speed independently of the rotation speed of the engine.

On the other hand, it is known from EP-A-1 362 993 to feed piston cooling positions with oil coming from a pump through a control valve which can be open or closed depending on a lubrication strategy. This allows correcting the influence of the rotation speed of the engine but does not permit to independently adjust the flow rate and the speed of oil coming out of a piston cooling jet.

On the other hand, in some working conditions of an internal combustion engine, e.g. under partial load or in idle conditions, oil can be provided to a piston cooling nozzle with the relatively low pressure, with a risk that the speed of the oil flow or jet coming out of the nozzle is not sufficient to reach the corresponding piston or to fill its cooling gallery.

Similar problems occur with nozzle used to inject oil toward other parts of the engine.

It is desirable to provide a nozzle adapted to efficiently direct a flow of oil toward a part of an engine even when its is fed with oil under relatively low pressure. In particular, the invention provides, according to an aspect thereof, a nozzle which enables to independently control both the oil flow rate and the oil speed in the jet of oil coming out of its outlet, which leads to an optimized cooling of the piston.

The invention concerns, according to an aspect thereof, a nozzle adapted to direct a jet of oil under pressure toward a piston of an internal combustion engine, this nozzle having a variable outlet section. It is characterized in that it is provided with mechanical means adapted to control its outlet section on the basis of the pressure of a fluid under pressure provided to these mechanical means independently of the flow of oil going through the outlet of this nozzle.

Thanks to an aspect of the invention, the mechanical means, which are piloted by the pressure of the fluid, can adjust the outlet section of the nozzle in order to adjust the speed of the oil going through this outlet, so that the flow of oil is permanently adapted to efficiently cool the piston, even if the pressure or the flow rate of the oil provided to the piston cooling jet varies.

According to further aspects of the invention, such a piston cooling nozzle might incorporate one or several of the following features:

- The mechanical means include a deformable wall defining the shape of the piston cooling jet outlet, whereas this wall closes a chamber adapted to be fed with the fluid under pressure.
- The wall surrounds the outlet of the nozzle.
- The chamber surrounds the wall.
- The wall is annular and located between the outlet and the chamber.
- The chamber is annular.
- An inlet conduit feeds fuel fluid under pressure to the chamber.
- The inlet conduit is adapted to be connected to a source of the oil flow going through the outlet of the piston cooling jet.
- An outlet conduit evacuates fluid under pressure from the chamber.
- The outlet conduit is provided with a restriction device.

The invention also concerns, according to an aspect thereof, a lubrication system for an internal combustion engine which comprises a pump feeding a main line, whereas an auxiliary line connects this main line to at least one nozzle, this auxiliary line being provided with first proportional means controlling oil flow within this line. This system is characterized in that it includes a control line connecting the main line or the auxiliary line, upstream of the first proportional means, to mechanical means adapted to control the outlet section of the nozzle on the basis of the pressure of oil delivered by the control line, whereas the control line is provided with second proportional means controlling the pressure of oil delivered to the mechanical means.

Thanks to an aspect of the invention, the second proportional means allow to actuate the mechanical means, via the pressure of oil delivered to these mechanical means, in order to adjust the outlet section of the nozzle.

According to further aspects of the invention, such a lubrication system might incorporate one or several of the following features:

- The nozzle is as mentioned here-above.
- The first and second proportional means are proportional valves controlling oil flow respectively within the auxiliary line and within the control line.
- The proportional means are piloted independently.
- The main line of the lubrication system provides oil to at least one support interface for a crankshaft of the engine.

The invention also concerns, according to an aspect thereof, an internal combustion engine equipped with a nozzle as mentioned here-above or a lubrication system as mentioned here-above.

BRIEF DESCRIPTION OF THE DRAWINGS

The invention will be better understood on the basis of the following description which is given in correspondence with the annexed figures and as an illustrative example, without restricting the object of the invention. In the annexed figures.

DETAILED DESCRIPTION

Figure 1:
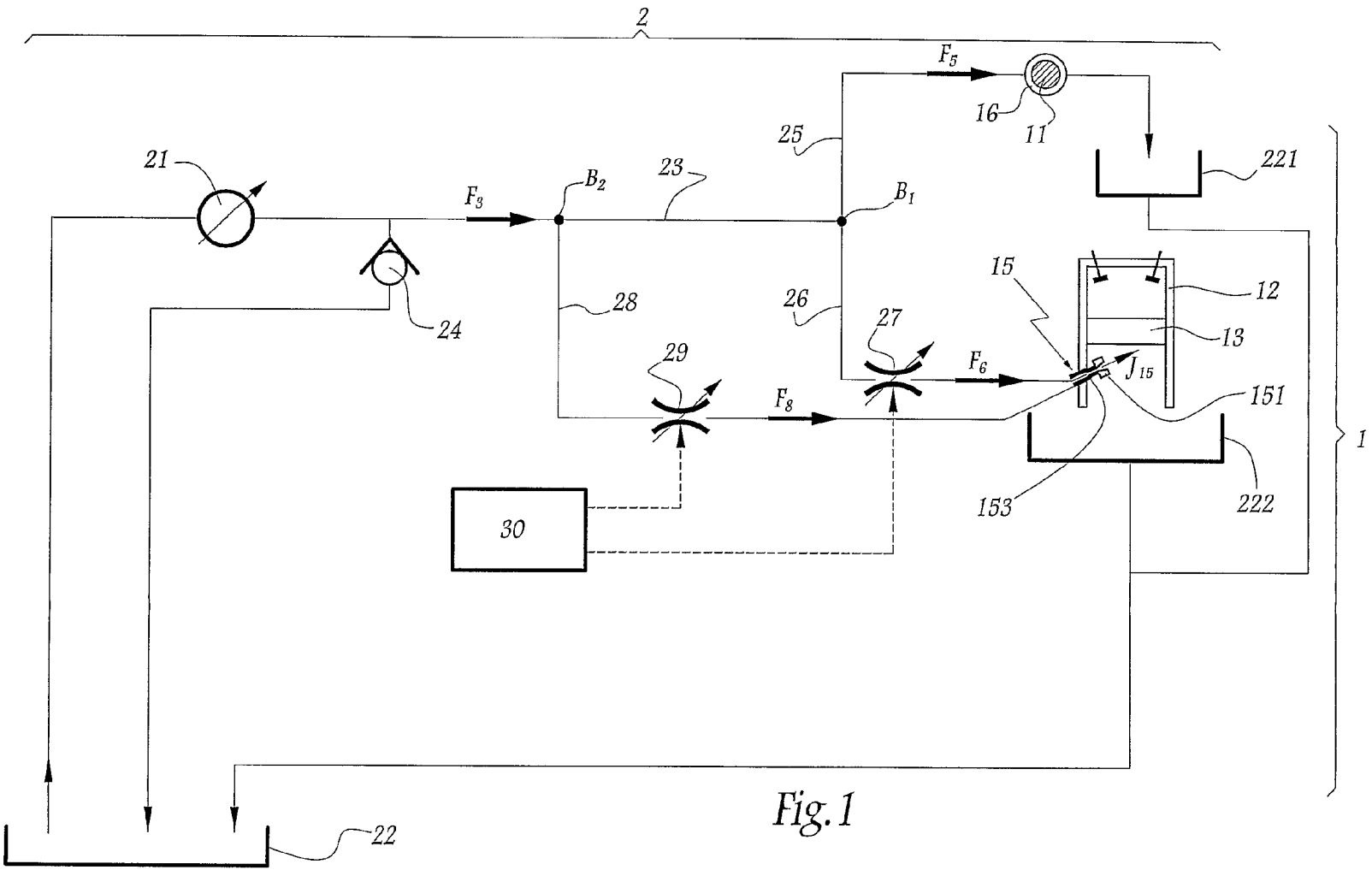
FIG. 1 is a scheme of a lubrication system according to the invention.

The internal combustion engine 1 represented on FIG. 1 comprises a crankshaft 11 and several cylinders 12, only one cylinder being represented. A piston 13 is slidably movable within each cylinder 12, between a top dead center position and a bottom dead center position represented on FIG. 1. A piston cooling nozzle or "piston cooling jet" 15 is provided for each cylinder 12 and adapted to direct a flow of oil toward its piston 13 in its bottom dead center position, as represented by arrow J15 on FIG. 1.

Crankshaft 11 is supported by several bearings 16. Only one such bearing is represented on FIG. 1. Oil is to be fed to each interface between a bearing 16 and crankshaft 11 and to each piston cooling nozzle 15.

To this purpose, a lubrication system 2 includes a mechanical variable flow oil pump 21 adapted to suck oil from a sump 22 and to feed it to a main line 23. Pump 21 is driven by engine 1 and its rotation speed depends on the rotation speed of engine 12. All piston cooling nozzles belong to lubrication system 2.

Pump 21 can be of any type of variable flow pump, e.g. a vane pump, a sliding gear pump, a variable timing pump like a gerotor pump, or a variable speed pump. An electrically driven oil pump can be used instead of mechanical pump 21, such as an electrical pump being electronically driven, so that it also provides a variable flow.

An optional safety pressure relief valve 24 is mounted on line 23 and is adapted to send oil back to sump 22, in case oil pressure within line 23 is higher than a predetermined level.

Oil in line 23 is provided to a first line 25 which feeds all interfaces between crankshaft 11 and bearings 16. The major part of oil in line 23 goes to line 25. Lines 23 and 25 form together a main sub-circuit of system 2. Oil coming out of the interfaces between elements 11 and 16 is directed to a first sump part 221 which is connected to sump 22. Oil sent by piston cooling nozzle 15 to piston 13 flows back to a sump part 222 which is also connected to sump 22.

An auxiliary line 26 is connected to main line 23 and feeds piston cooling nozzle 15 with oil under pressure coming out of a pump 21.

According to an embodiment of the invention which is not represented, line 26 can feed several piston cooling nozzles 15.

One notes B-i the junction point between lines 23 and 26. A proportional valve 27 is mounted on line 26, between point B-i and piston cooling nozzle 15.

A control line 28 is connected to line 23, upstream of point Bi and is adapted to feed a control chamber 151 formed around the outlet 152 of piston cooling nozzle 15. One notes B2 the junction point between lines 23 and 27. B2 is upstream of Bi on line 23. A proportional valve 29 is mounted on line 28, between point B2 and chamber 151.

Valves 27 and 29 are solenoid valves and an electronic control unit 30 is connected to each of these two valves in order to independently control their respective opening.

The flow F3 of oil under pressure within line 23 is divided between a flow F5 in line 25, a flow F6 in line 26 and a flow F8 in line 28. The flow rate of flow F5 is larger than the flow rates of flows F6 and Fs. In other words, most of the oil coming out of pump 21 goes to the interfaces between crankshaft 11 and bearings 16.

The jet J15 of oil coming out of nozzle 15 and directed toward piston 13 is controlled thanks to solenoid valves 27 and 29. More precisely, valve 27 controls flow F6 toward the inner volume 153A of a tubular body 153 of piston cooling nozzle 15. Solenoid valve 27 allows decreasing the pressure of the oil sent toward nozzle 15. In other words, if one notes P3 the pressure of flow F3 within line 23, proportional valve 27 allows to control the pressure P6 of oil fed to volume 153A, as flow F6, between 0 and P3. Similarly, proportional valve 29 allows controlling the pressure P8 of oil provided to chamber 151, as flow F8, between 0 and P3. In other words, solenoid valves 27 and 29 work as flow reductors for flows F6 and F8 in the downstream parts of lines 26 and 28.

A metallic shell 154 surrounds outlet 152 and a flexible wall 155 closes shell 154 so that chamber 151 is isolated from the jet or spray J15 coming out of nozzle 15 via outlet 152. Flexible wall 155 is made of a rubber sleeve. Any other flexible materials, like synthetic elastomer, are also suitable for wall 155.

Figure 2:
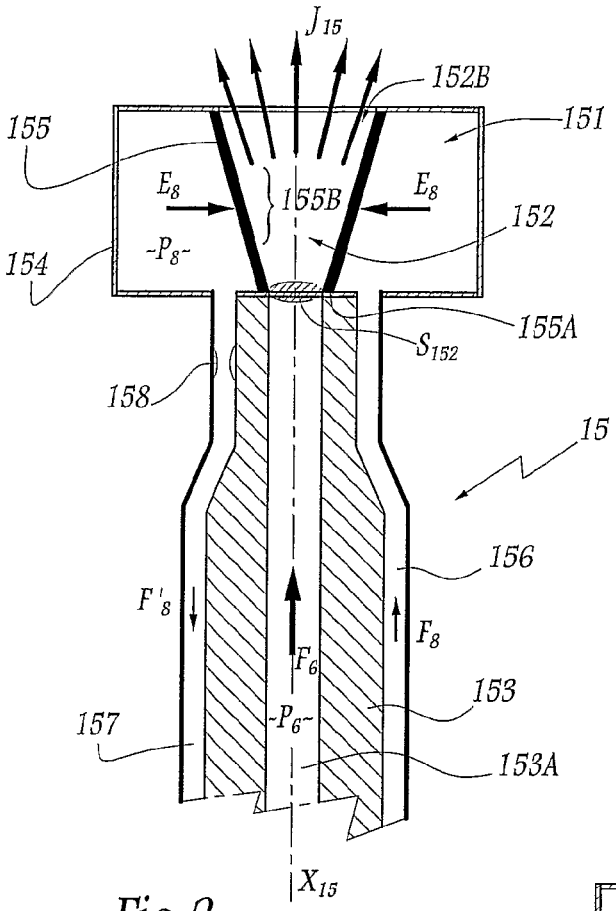
FIG. 2 is a longitudinal cut view of a piston cooling nozzle according to the invention and belonging to the system of FIG. 1.

One notes S152 the minimum surface area of outlet 152 taken perpendicularly to a longitudinal axis X15 of nozzle 15. In the configuration of FIG. 2, surface area S152 is located at the upstream extremity 155A of wall 155 which is next to body 153, that is at the level of the entry zone 152A of outlet 152.

Considering that pressure losses between valve 29 and chamber 151 are negligible, pressure P8 applies on the outer surface of sleeve 155 and exerts a centripetal effort E8 directed toward axis Xi5. The magnitude of effort E8 depends on pressure P8. Therefore, depending on the value of pressure P8, sleeve 155 might take several configurations, as can be understood from the comparison of FIGS. 2 and 3.

During normal operation of engine 1, e.g. when a vehicle equipped with this engine runs on a flat motorway, when engine load is not full, it is possible to reduce the flow rate of the piston cooling flow F6. This is due to thermal considerations since heat rejection through the piston is substantially proportional to the engine output power. Reducing flow F6, for instance by 50 percent, can be done by partially closing valve 27. When valve 27 is partially closed, the pressure P6 of flow F6 and the speed of oil within line 26 are reduced.

If flexible wall 155 remains in the configuration of FIG. 2, the speed of the jet J15 coming out of nozzle 15 decreases, which might lead to an incomplete cooling of piston 13. Indeed, if piston velocity is higher than the speed of jet Ji5, this jet may not impact piston 13 in some phases of its movement. In order to keep a high speed for jet J-15, one reduces the outlet area of nozzle 15, that is surface area Si52 of outlet 152. This is done by changing the shape of outlet 152 through a modification of the configuration of flexible wall 155 as shown on FIG. 3. Control of valve 29 is piloted by unit 30 in order to provide chamber 151 with oil under relatively high pressure P8, P8 being for instance higher than P6 in this case. In other words, in order to keep a high flow speed for jet Ji5, valve 29 is open so that pressure P8 increases in such a way that wall 155 is resiliency deformed from the configuration of FIG. 2 to the configuration of FIG. 3. Flexible wall 155 deforms radially toward axis Xi5, in a centripetal direction, which induces a reduction of the minimum surface area S-152 of outlet 152

Figure 3:
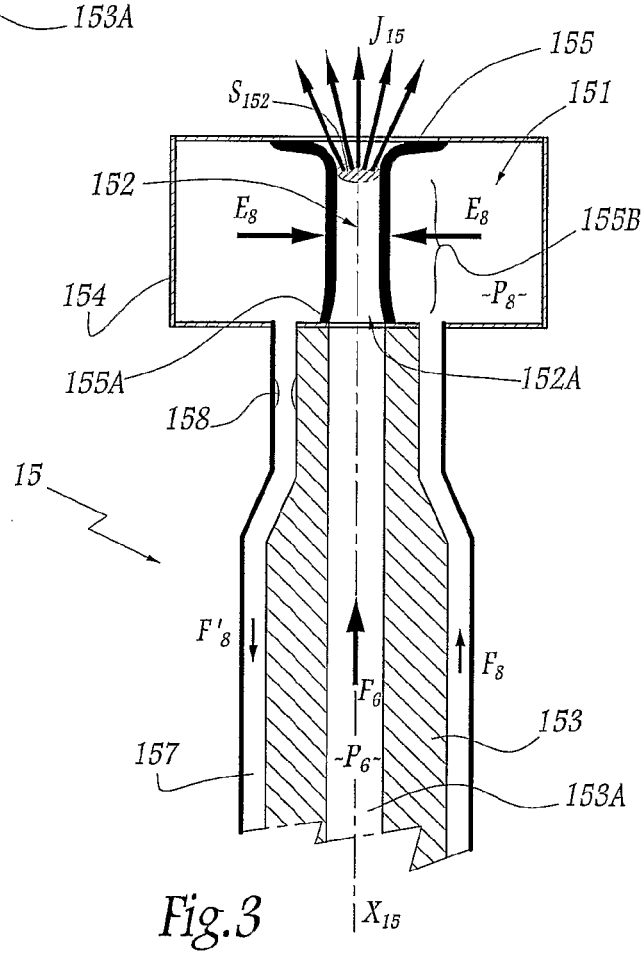
FIG. 3 is a cut view similar to FIG. 2 when the piston cooling nozzle is in another configuration.

In other words, valve 29 allows to control, via pressure P8 and effort E8, the shape of outlet 152, which controls the speed of jet Ji5, whereas the flow rate of flow F6 and its pressure P6 can be controlled by valve 27. In the configuration of FIG. 3, surface Si52 is close to the exit zone 152B of outlet 152. The surface area of outlet 152 close to exit zone 152B has a great influence on the speed of jet Ji5.

Piston cooling nozzle 15 is provided with an inlet conduit 156 which enables to feed chamber 151 with oil coming from line 28. Piston cooling jet 15 is also provided with an outlet conduit 157 which enables to evacuate oil under pressure from chamber 151, as a resulting flow F's directed toward sump 222. A restrictor 158 is provided in conduit 157 in order to create a pressure drop so that oil with pressure P8 can accumulate within chamber 151 in order to exert effort E8 on wall 155 as explained here-above. Outlet conduit 157 is connected to sump 22 as shown on FIG. 1.

According to an alternative embodiment of the invention, conduit 157 can be omitted and valve 29 can be a three ways valve which can be switched into a given position to empty chamber 151 into sump 222.

Wall 155 is frustroconical when no substantial pressure difference applies on its inner and outer surfaces, as shown on FIG. 2. When a pressure difference applies, as shown on FIG. 3, wall 155 is cylindrical with a circular basis and an almost rectilinear generating line. It could have other shapes, e.g. with a non circular basis, provided that it allows an efficient control of jet J-15.

The invention is very relevant in case several nozzles 15 are fed via a single auxiliary line 28, e.g. in case each cylinder is provided with two or more nozzles 15. In such a case, a single control valve 29 can pilot as many nozzles as necessary.

The invention has been represented on FIG. 1 with line 28 branching out of line 23. However, line 28 can also be created by a derivation of line 26, provided that the junction point between lines 26 and 28 is upstream of valve 27.

According to an alternative embodiment of nozzle 15, its chamber 151 can be fed with a control fluid different from the oil directed toward the piston, e.g. water.

The invention has been described with reference to its use with piston cooling nozzles but it can also be implemented with other types of oil injection nozzles in an engine, e.g. nozzles used to direct oil toward a cam-roller interface in a set of socker arms of en engine.

List of References

1 internal combustion engine
11 crankshaft
12 cylinder
13 piston
15 piston cooling nozzle
151 control chamber
152 outlet
153 body
153A inner volume of 153
154 shell
155 flexible wall
155A upstream extremity
155B intermediate position
156 inlet conduit
157 outlet conduit
158 restrictor
2 lubrication system
21 pump
22 sump
221 sump part
222 sump part
23 main line
24 relief valve
25 first line
26 auxiliary line
27 proportional valve
28 control line
29 proportional valve
30 electronic control unit
Bi junction point between 23 and 26
B2 junction point between 23 and 27
E8 centri petal effort due to P8
F3 flow in line 23
F5 flow in line 25
F6 flow in line 26
F8 flow in line 28 and conduit 156
F's resulting flow in conduit 157
J15 jet coming out of nozzle 15
P3 pressure of flow F3
P6 pressure of flow F$\epsilon$
P8 pressure of flow F8
S-152 minimum surface are of 152
X15 longitudinal axis of 15

The invention claimed is:

1. A nozzle adapted to direct a jet of oil under pressure in an internal combustion engine, the nozzle comprising an outlet portion having an upstream end and a downstream end, a shape of the outlet portion being adapted to be varied in cross-section when viewed perpendicular to an axis extending between the upstream and downstream end and mechanical means adapted to control the cross-section of the outlet portion based on pressure of fluid under pressure provided to the mechanical means independently of a flow of oil going through the outlet of the nozzle.

2. A nozzle according to claim 1, wherein the mechanical means include a flexible wall defining the shape of the outlet and in that the wall closes a chamber adapted to be fed with fluid under pressure.

3. A nozzle according to claim 2, wherein the wall surrounds the outlet.

4. A nozzle according to claim 3, wherein the chamber surrounds the wall.

5. A nozzle according to claim 2, wherein the wall is annular and located between the outlet and the chamber.

6. A nozzle according to claim 2, wherein the chamber is annular.

7. A nozzle according to claim 2, wherein it includes an inlet conduit for feeding the chamber with fluid under pressure

8. A nozzle according to claim 7, wherein the inlet conduit is adapted to be connected to a source of the oil flow going through the outlet.

9. A nozzle according to claim 8, wherein the outlet conduit is provided with a restriction device.

10. A nozzle, according to claim 2, wherein an outlet conduit for evacuating fluid under pressure from the chamber.

11. A nozzle according to claim 1, wherein it is a piston cooling nozzle adapted to direct a jet of oil under pressure toward a piston of an internal combustion engine.

12. An internal combustion engine equipped with a piston cooling nozzle according to claim 1.

13. A lubrication system for an internal combustion engine, the system comprising:

a pump feeding a main line, an auxiliary line, a nozzle comprising an outlet portion having an upstream end and a downstream end, a shape of the outlet portion being adapted to be varied in cross-section when viewed perpendicular to an axis extending between the upstream and downstream end, the auxiliary line connecting the main line to the nozzle, the auxiliary line being provided with first proportional means controlling oil flow within the auxiliary line, a control line connecting the main line or the auxiliary line upstream of the first proportional means to mechanical means adapted to control the cross-section of the outlet portion of the nozzle based on pressure of oil delivered via the control line to the mechanical means independently of a flow of oil going through the outlet of the nozzle, and second proportional means provided in the control line controlling the pressure of oil delivered to the mechanical means.

14. A lubrication system according to claim 13, wherein the first and second proportional means are proportional valves controlling oil flow respectively within the auxiliary line and within the control line.

15. A lubrication system according to claim 13, wherein the proportional means are piloted independently.

16. A lubrication system according to claim 13, wherein the main line provides oil to at least one support interface for a crankshaft of the engine.

17. An internal combustion engine equipped with a lubrication system according to claim 13.

18. A nozzle adapted to direct a jet of oil under pressure in an internal combustion engine, the nozzle comprising a chamber, a flexible wall defining a passage for flow of the oil and part of the chamber, and a conduit leading to the chamber and adapted to be connected to a source of fluid under pressure independently of the flow of oil going through the passage so that a shape of the flexible wall is a function of a pressure of the fluid.

19. A nozzle adapted to direct a jet of oil under pressure in an internal combustion engine, the nozzle comprising a first passage for flow of the oil, a second passage for receiving a fluid, independent of the flow of oil, wherein an internal volume of the first passage is a function of a pressure of the fluid.

* * * * *

UNITED STATES PATENT AND TRADEMARK OFFICE

CERTIFICATE OF CORRECTION

PATENT NO. : 8,256,388 B2
APPLICATION NO. : 12/518295
DATED : September 4, 2012
INVENTOR(S) : Luc Aixala It is certified that error appears in the above-identified patent and that said Letters Patent is hereby corrected as shown below:

Title Page, Item (73), the assignee's name is incorrectly spelled as "Renault Trulles" and it should be spelled as --Renault Trucks--.

Signed and Sealed this
Ninth Day of October, 2012

David J. Kappos

David J. Kappos
*Director of the United States Patent and Trademark Office*